United States Patent [19]

Hayashi et al.

[11] Patent Number: 4,559,798

[45] Date of Patent: Dec. 24, 1985

[54] FILLET ROLLING MACHINE

[75] Inventors: Takehiko Hayashi, Toyota; Hiroyuki Ikuta, Nagoya; Toshiki Shindo, Ohbu, all of Japan

[73] Assignee: Toyoda Koki Kabushiki Kaisha, Kariya, Japan

[21] Appl. No.: 654,365

[22] Filed: Sep. 26, 1984

[30] Foreign Application Priority Data

Jul. 9, 1984 [JP] Japan ..... 59-140585
Jul. 9, 1984 [JP] Japan ..... 59-140586
Jul. 9, 1984 [JP] Japan ..... 59-140587

[51] Int. Cl.[4] ..... B21K 1/08
[52] U.S. Cl. ..... 72/81; 72/110
[58] Field of Search ..... 72/81, 107, 110

[56] References Cited

U.S. PATENT DOCUMENTS 4,118,845 10/1978 Korte ..... 72/81
4,437,328 3/1984 Wittkopp et al. ..... 72/110
4,485,537 12/1984 Berstein et al. ..... 72/110

FOREIGN PATENT DOCUMENTS 54-117849 9/1979 Japan .
957711 5/1964 United Kingdom ..... 72/110

*Primary Examiner*—Lowell A. Larson

*Attorney, Agent, or Firm*—Oblon, Fisher, Spivak, McClelland & Maier

[57] ABSTRACT

A fillet rolling machine having a frame, on which a work spindle with a chuck is carried for rotation about a horizontal axis. A tailstock is mounted on the frame for supporting one end of a crankshaft to be processed while the same is grasped and rotated by the chuck. A head support is movable on the top of the frame in a direction parallel to the axis of the work spindle and carries first to third support shafts in parallel relation with the axis of the work spindle. The first and second support shafts, disposed in parallel with each other, respectively carry first and second rolling heads which respectively effect rolling treatments on fillets formed at one of journals and one of crankpins adjacent thereto of the crankshaft. The third support shafts, disposed co-axially with the first support shaft, carries a third rolling head which effects a rolling treatment on a fillet formed at a front journal of the crankshaft. Each journal and crankpin gripped by the front ends of the associated rolling heads are given rolling treatments during the rotation of the work spindle. A servomotor controllable in accordance with numerical control data is drivingly connected to the head support, so that first and second rolling heads can be brought into respective alignments with any pair of a journal and a crankpin of the crankshaft.

10 Claims, 7 Drawing Figures

FILLET ROLLING MACHINE

BACKGROUND OF THE INVENTION

1. Field of the Invention

The present invention relates to a machine for effecting rolling treatments on fillets of journals and crankpins of crankshafts used in automotive engines.

2. Description of the Prior Art

Generally, rolling treatments are effected on fillets formed on journals and crankpins of crankshafts for an increased strength. In a known fillet rolling machine as disclosed in Japanese Unexamined, Published Patent Application No. 54-117849, a plurality of rolling heads each holding fillet rollers for rolling fillets of crankpins (or journals) of a crankshaft are arranged in respective alignments with the crankpins (or journals) to be processed. This arrangement enables the fillets of the crankpins (or journals) to be simultaneously subjected to rolling treatments. The known apparatus is further provided with a master crankshaft which corresponds in configuration to the crankshaft to be processed. The master crankshaft is used to impart rocking motions to the rolling heads each holding the fillet rollers.

However, the use of the master crankshaft makes the known apparatus unable to be easily adapted for a crankshaft which is different in pin-to-pin pitch, journal-to-journal pitch, or journal-to-pin stroke from the crankshaft which corresponds to the master crankshaft in configuration. Thus, various manual preparatory procedures such as a replacement of the master crankshaft, an axial position adjustment of each rolling head and so forth are required in order to make the known apparatus ready for such a different crankshaft. That is, the known apparatus has small flexibility to various kinds of crankshafts and therefore, is difficult to enhance the efficiency in the fillet rolling processings.

SUMMARY OF THE INVENTION

Accordingly, it is a primary object of the present invention to provide an improved fillet rolling machine which does not use any master crankshaft for large flexibility to, or an extended adaptation for, various kinds of crankshafts to be processed.

Another object of the present invention is to provide an improved fillet rolling machine of the character set forth above wherein a head support carrying a fillet rolling head is moved in accordance with numerical control data to selectively bring the rolling head into alignment with journals (or crankpins) of a rotating crankshaft to be processed so that the journals (or crankpins) each with fillets can be successively processed by the fillet rolling head.

Still another object of the present invention is to provide an improved fillet rolling machine of the character set forth above wherein a second fillet rolling head is also carried by the head support and through movement of the head support, is selectively brought into alignment with crankpins (or journals) of a rotating crankshaft to be processed so that the crankpins (or journals) each with fillets can be successively processed by the second fillet rolling head.

A further object of the present invention is to provide an improved fillet rolling machine of the character set forth above which is capable of automatically adjusting the space between the first fillet rolling head and the second fillet rolling head in accordance with numerical control data so as to make it possible to simultaneously effect rolling treatments upon a certain journal and a crankpin next thereto of each of crankshafts which are different from one another in journal-to-pin pitch.

A still further object of the present invention is to provide an improved fillet rolling machine of the character set forth above wherein at least one of the first and second rolling heads is capable of grasping journals or crankpins of a crankshaft to be processed with appropriate clamping forces which depend upon the axial locations of the journals or crankpins at the crankshaft.

An additional object of the present invention is to provide an improved fillet rolling machine of the character set forth above wherein a third rolling head for effecting a rolling treatment upon a journal located at the front side of a crankshaft is also carried by the head support to be adjustable relative to the first rolling head in a direction parallel to the axis of the crankshaft.

Briefly, according to the present invention, there is provided a fillet rolling machine comprising a support device mounted on a frame for rotatably supporting a crankshaft to be processed and a drive device connected to the support device for rotating the crankshaft about the axis of the same. A head support is mounted on the frame for movement in a direction parallel to the axis of the crankshaft being supported by the support device. At least one fillet rolling head is carried by the head support for effecting a rolling treatment upon fillets formed on journals (or crankpins) of the crankshaft. An indexing feed device connected to the head support is controlled in accordance with numerical control data for moving the head support in such a manner as to selectively bring the at least one fillet rolling head into alignment with the journals (or crankpins) of the crankshaft.

With this configuration, since the position of the rolling head in the axial direction of the crankshaft is automatically adjustable in accordance with numerical control data, it is possible to effect rolling treatments upon fillets on any of the journals (or crankpins) of various crankshafts which are different from one another in journal-to-journal (or pin-to-pin) pitch. Therefore, the flexibility of the machine according to the present invention can be extended.

In another aspect of the present invention, another or a second fillet rolling head is also carried by the head support. This enables the machine to effect rolling treatments upon the fillets of one of crankpins (or journals) at the same time as the first rolling head effects rolling treatments upon the fillets of one of the journals (or crankpins).

In still another aspect, the fillet rolling machine according to the present invention is further provided with a space adjusting mechanism, which is responsive to numerical control data for automatically adjusting the position of the second rolling head relative to the first rolling head in the axial direction of the crankshaft. This enables the machine to simultaneously effect rolling treatments upon a journal and a crankpin of each of the crankshafts which are different from one another in journal-to-pin pitch.

BRIEF DESCRIPTION OF THE ACCOMPANYING DRAWINGS

The foregoing and other objects, features and many of the attendant advantages of the present invention will be readily appreciated as the same becomes better understood by reference to the following detailed description of a preferred embodiment, wherein like reference numerals designate identical or corresponding parts throughout the several views, and in which.

DETAILED DESCRIPTION OF THE PREFERRED EMBODIMENT

Figure 1:
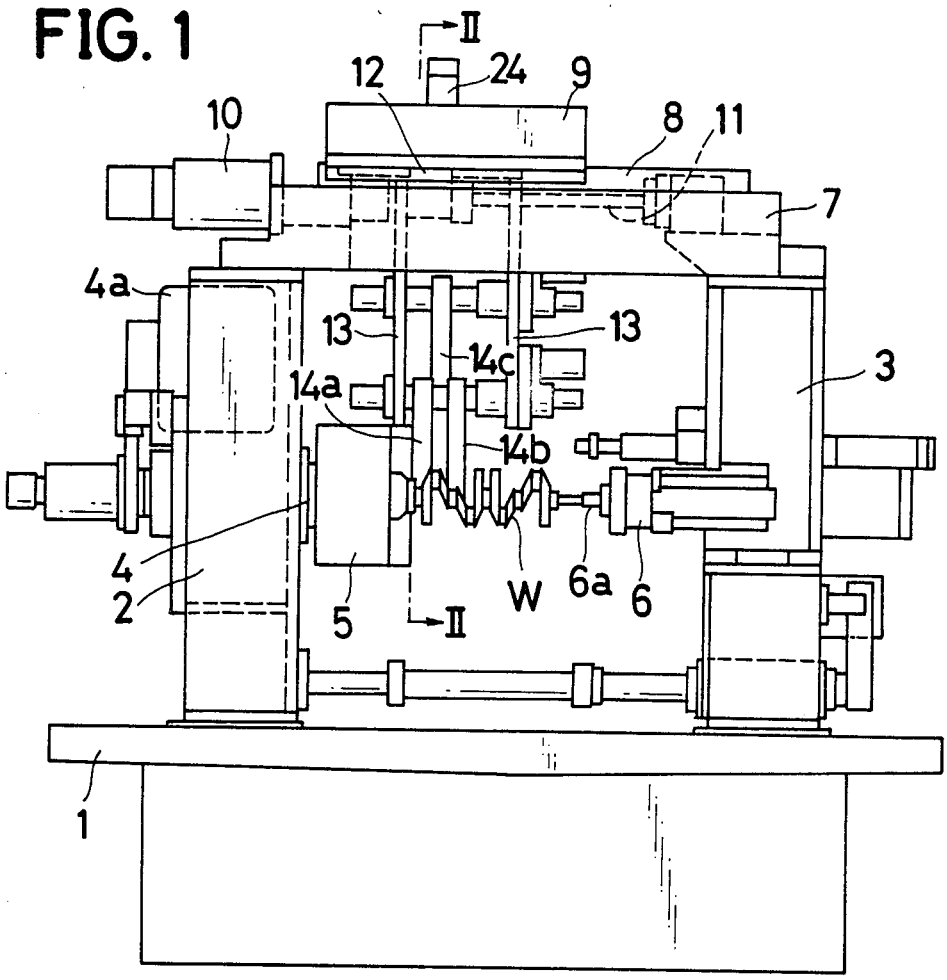
FIG. 1 is a front view of a fillet rolling machine according to the present invention.

Referring now to the drawings and particularly to FIG. 1 thereof, a reference numeral 1 denotes a bed, on which a pair of upstanding columns 2 and 3 constituting a frame are fixedly mounted. The column 2 carries a work spindle 4, which is rotatable by a spindle drive motor 4*a* about a horizontal axis and which is controllable with respect to its rotational angular position. A chuck 5 is secured to an inner end of the work spindle 4. The column 3 carries a tailstock 6, whose center 6*a* cooperates with the chuck 5 to support a crankshaft W as a workpiece.

Figure 2:
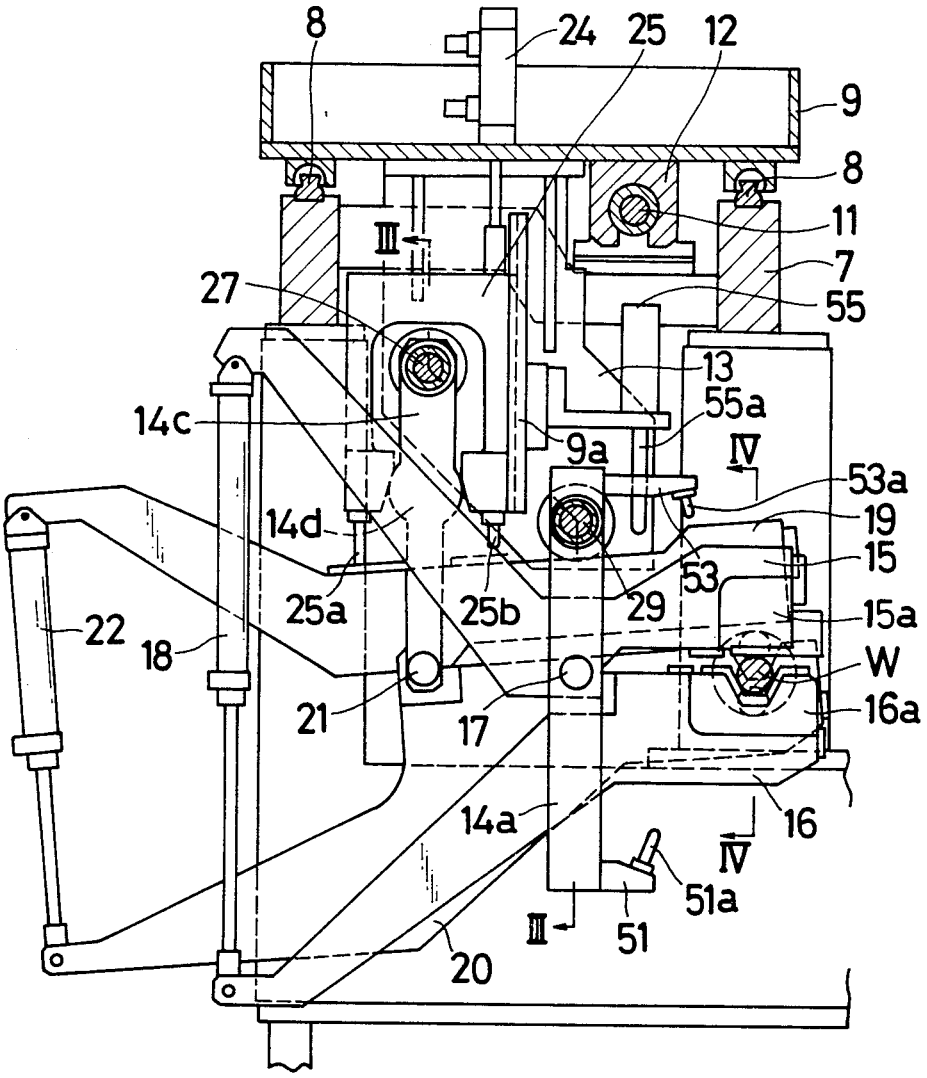
FIG. 2 is an enlarged sectional view of the machine taken along the line II—II in FIG. 1.

A guide base 7 is secured at its opposite ends respectively to the tops of the columns 2 and 3. As best shown in FIG. 2, a pair of guide rails 8 and 8 are provided on the top of the guide base 7 and horizontally extends in parallel relation with the axis of the crankshaft W. A head support 9 is guided by the guide rails 8 and 8 to be movable therealong in accordance with numerical control data. To effect movement of the head support 9, there is provided a servomotor 10 for rotating a ball screw 11 which is in threaded engagement with a nut 12 secured to the lower surface of the head support 9.

A pair of support plates 13 and 13 depend from the lower surface of the head support 9. The support plates 13 and 13 carry first and third rocking arms 14*a* and 14*b* pivotable about an axis parallel with the axis of the crankshaft W and also carry a second rocking arm 14*c* pivotable about another axis parallel with the axis of the crankshaft W, as described below in greater detail.

Figure 3:
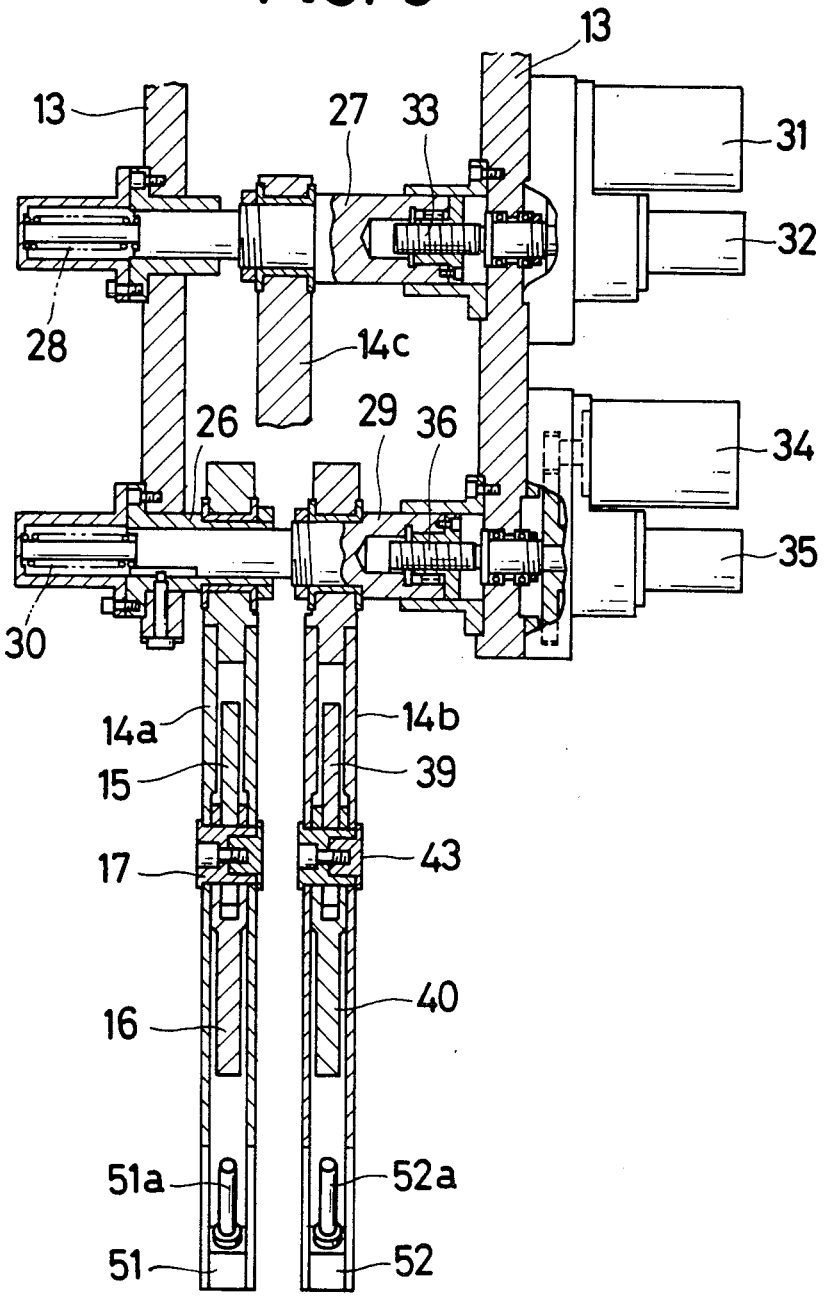
FIG. 3 is a sectional view of the machine taken along the line III—III in FIG. 2.
Figure 4:
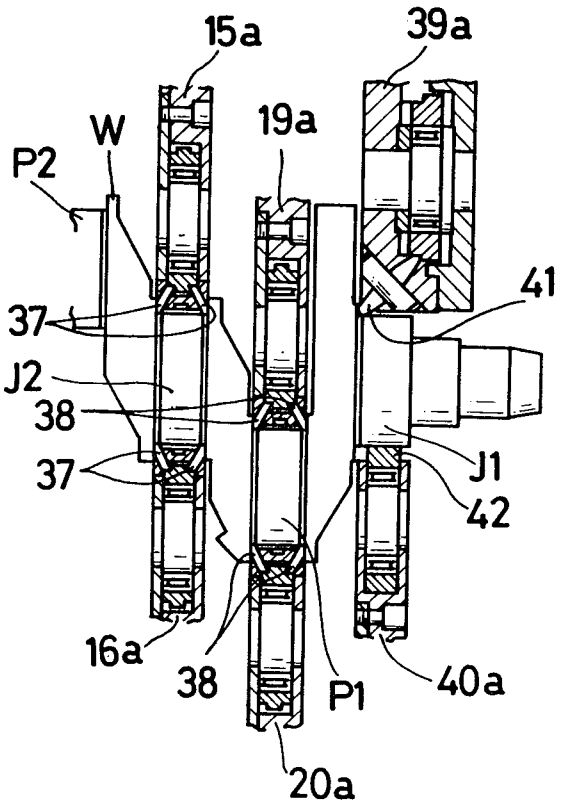
FIG. 4 is an enlarged fragmentary sectional view of the machine taken along the line IV—IV in FIG. 2.

As shown in FIGS. 2 through 4, the first rocking arm 14*a* constituting a first rolling head is provided at its mid portion with a pivot shaft 17 extending in parallel to the axis of the work spindle 4. The pivot shaft 17 pivotably carries a pair of upper and lower journal clamping plates 15 and 16. These plates 15 and 16 are provided with removable roller holders 15*a* and 16*a* at their front ends, respectively. The roller holders 15*a* and 16*a* rotatably carry fillet rollers 37, which are engageable with fillets formed at axial opposite ends of each journal of the crankshaft W, as best shown in FIG. 4. A hydraulic cylinder 18 is connected to the rear ends of the clamping plates 15 and 16 for opening or closing the same.

The second rocking arm 14*c* constituting a second rolling head is provided at its lower end with a pivot shaft 21 extending in parallel with the axis of the work spindle 4. A pair of upper and lower pin clamping plates 19 and 20 are pivotably carried by the pivot shaft 21 for opening and closing motion. The pin clamping plates 19 and 20 respectively removably carry roller holders 19*a* and 20*a* at their front ends, as shown in FIG. 4. These roller holders 19*a* and 20*a* rotatably carry fillet rollers 38, which are engageable with fillets formed at axial opposite ends of each crankpin of the crankshaft W. The pin clamping plates 19 and 20 are connected at their rear ends to a hydraulic cylinder 22 to be opened or closed thereby.

In the same manner as the first rocking arm 14*a*, as shown in FIG. 3, the third rocking arm 14*b* constituting a third rolling head carries a pair of upper and lower journal clamping plates 39 and 40, which are pivotable about a pivot shaft 43 provided at the mid portion of the third rocking arm 14*b*. As shown in FIG. 4, a roller holder 39*a*, removably mounted on the front end of the upper journal clamping plate 39, rotatably carries a sigle large fillet roller 41 engageable with a single fillet which is formed on a front or first journal J1 of the crankshaft W, while a roller holder 40*a* removably mounted on the front end of the lower clamping plate 40 rotatably carries a back-up roller 42 engageable with the front journal J1.

Secured to lower ends of the first and third rocking arms 14*a* and 14*b* are lower plate rests 51 and 52, which upwardly protrude lower rest shoes 51*a* and 52*a* for abutting engagements with the lower journal clamping plates 16 and 40, respectively. Further, the first and third rocking arms 14*a* and 14*b* have secured to their upper ends upper plate rests 53 (only one shown) which downwardly protrude upper rest shoes 53*a* for abutting engagement with the upper journal clamping plates 15 and 39, respectively. The lower journal clamping plates 16 and 40, when opend by the respective hydraulic cylinders 18, are rested upon the lower rest shoes 51*a* and 52*a*, while the upper journal clamping plates 15 and 39, when opened by the hydraulic cylinders 18, are rested upon the upper rest shoes 53*a*. Thus, positions of the upper and lower journal clamping plates 15, 39, 16 and 40 at the rest condition can be determined.

The head support 9 has a dovetail vertical guide 9*a* depending therefrom. A U-shaped positioning plate 25 is guided by the vertical guide 9*a* and is connected to a hydraulic cylinder 24 mounted on the head support 9. The positioning plate 25 is engageable at its byfocated lower ends with a spherical portion 14*d* formed at the mid portion of the second rocking arm 14*c*. This engagement causes the second rocking arm 14*c* to be positioned vertically. The byforcated ends of the positioning plate 25 respectively protrude a pair of spring-biased plungers 25*a* and 25*b* downwardly from the lower surfaces thereof. When lowered by the hydraulic cylinder 24, the byforcated ends are brought into abutting engagement with the spherical portion 14*d* of the second rocking arm 14*c*, and the plungers 25*a* and 25*b* are brought into engagement with the upper pin clamping plate 19. Thus, angular positions of the pin clamping plates 19 and 20 are determined for permitting the loading of the crankshaft W.

Axial positions of the second and third rocking arms 14*c* and 14*b* relative to the first rocking arm 14*a* are independently adjustable. Mechanisms for such adjustment will be described with reference to FIG. 3. The first rocking arm 14*a* is pivotably carried by a fixed sleeve 26 secured to one of the support plates 13 and 13, whereas the third rocking arm 14*b* is pivotably carried by a first support shaft 29, which is carried by the other support plate 13 in co-axial alignment with the fixed sleeve 26 for axial movement between the support plates 13 and 13. A first screw 36 in threaded engagement with the support shaft 29 is rotatably carried by the other support plate 13 and is drivingly connected to a servomotor 35 secured to the other support plate 13. An encoder 34 secured to the other support plate 34 detects the rotational angle of the screw 36 to control the operation of the servomotor 35. Thus, rotation of the first screw 36 is controlled in accordance with numerical control data, so that the space between the first and third rocking arms 14*a* and 14*b* is automatically adjusted to establish a desired journal-to-journal pitch. A reference numeral 30 denotes a spring serving to eliminate a backlash on the threaded engagment.

Similarly, the second rocking arm 14*c* is axially adjustable to change the space between the first and second rocking arms 14*a* and 14*c*. More specifically, a second support shaft 27 pivotably carrying the second rocking arm 14*c* thereon is carried by the support plates 13 and 13 for axial movement in parallel relation with the first support shaft 29. The second support shaft 27 is in threaded engagement with a second screw 33, which is drivingly connected by a servomotor 32 secured to the other support plate 13. The servomotor 32 is under the control of an encoder 31 which detects the rotational amount of the second screw 33. Therefore, an adjusted rotation is given to the second screw 33 so as to automatically adjust the space between the first and second rocking arms 14*a* and 14*c* to establish to a desired journal-to-pin pitch. A spring 28 is also provided for eliminating the backlash on the threaded engagement.

Furthermore, a pin locating cylinder 55 is attached to the vertical guide 9*a* through a suitable bracket (not numbered), with a piston rod 55*a* thereof being extensible vertically, as shown in FIG. 2. The piston rod 55*a*, when lowered, hits upon the upper pin clamping plate 19. This causes the upper pin clamping plate 19 to rotate a crankpin aligned therewith around the axis of the workpiece W so as to bring the crankpin to the possible lowest angular position in such a situation that the crankshaft W is carried by a loading/unloading device (not shown) without being grasped by the chuck 5.

The operation of the machine as constructed above will be described hereafter. When a crankshaft W to be processed is supplied to the loading/unloading device, an operation start command is generated, in response to which the loading/unloading device presents the crankshaft W between the chuck 5 and the tailstock 6. The servomotor 10 is then operated in accordance with numerical control data so as to bring the first to third rocking arms 14*a*, 14*c* and 14*b* into respective alignments with a second journal J2, a first crankpin P1 and a first journal J1 of the crankshaft W, as shown in FIG. 4. The pin locating cylinder 55 is then operated, which causes the upper pin clamping plate 19 to push down the first crankpin P1, whereby the angular position of the crankshaft W is determined. All of the journal and pin clamping cylinders 18, 22 are subsequently operated, which respectively effect closing motions of the first pair of journal clamping plates 15 and 16, the single pair of pin clamping plates 19 and 20 and the second pair of journal clamping plates 39 and 40. Consequently, as shown in FIG. 4, the fillets of the second journal J2 are engaged with the rollers 37, and the fillets of the first crankpin P1 are engaged with the rollers 38. On the other hand, the first journal J1 is engaged with the roller 42, with the single fillet thereof being engaged with the large roller 41. The pin locating cylinder 55 is reversely operated at the same time as the operations of the journal and pin clamping cylinders 18 and 22 so as to permit the subsequent rocking motion of the pin clamping plates 19 and 20. The operations of the chuck 5 and the tailstock 6 are then effected, whereby a rear flange portion of the crankshaft W is grasped by the chuck 5, while the front end of the crankshaft W is engaged with the center 6*a* of the tailstock 6.

Thereafter, the positioning plate 25 is upwardly moved by the operation of the cylinder 24 so as to make the upper pin clamping plate 19 ready for subsequent rocking motion. A fillet rolling step begins when the crankshaft W along with the chuck 5 is rotated by the operation of the spindle drive motor 4*a*. During this rolling step, each of the fillet rollers 38 carried by the upper and lower pin clamping plates 19 and 20 is revolved around the first crankpin P1 as it rotates about the axis thereof. The revolution of each fillet rollers 38 around the first crankpin P1 is permitted through rocking motion of the second rocking arm 14*c* about the second support shaft 27 as well as rocking motion of the upper and lower pin clamping plates 19 and 20 about the pivot shaft 21. On the other hand, the fillet rollers 37 carried by the first pair of upper and lower journal clamping plates 15 and 16 roll the fillets of the second journal J2 while rotating about their own axes. The single large fillet roller 41 carried by the upper journal clamping plate 39 works in the same manner as each of the fillet rollers 37. A misalignment of the first journal J1 from the axis of the work spindle 4 is absorved throught rocking motion of the clamping plates 39, 40, while a misalignment of the second journal J2 from the axis of the work spindle 4 is absorved through rocking motion of the clamping plates 19 and 20. In this manner, the fillets of the first and second journals J1 and J2 and the first crankping P1 are simultaneously given fillet rolling treatments.

Rotation of the work spindle 4 is discontinued at the expiration of a predetermined period of time. When the work spindle 4 is stopped at a predetermined angular position, the positioning cylinder 24 is operated to move the positioning plate 25 downwardly, and the clamping cylinders 18 and 22 are operated to open the associated pairs of clamping plates 15, 16, 19, 20 and 39, 40. A 180-degree rotation of the work spindle 4 is then effected to present the second crankpin P2 (see FIG. 4) to the lower angular position. At the same time, the sevomotor 10 is operated until the first pair of journal clamping plates 15, 16 and the single pair of pin clamping plates 19, 20 are brought into respective alignments with the third journal J3 (not shown) and the second crankpin P2 of the crankshaft W. The 180-degree rotation of the work spindle 4 is followed by the reverse operation of the positioning cylinder 24 and by the operation of the locating cylinder 55. As a result, the positioning plate 25 is upwardly moved to release the second rocking arm 14*c* from restraint thereby, and the upper pin clamping arm 19 is moved down to locate the second crankpin P2 to the lowest angular position, during which time the chuck 5 is temporarily loosened to permit free rotation of the crankshaft W.

The clamping cylinders 18 and 22 are then operated, which enables the journal clamping plates 15, 16 and the pin clamping plates 19, 20 to grasp the third journal J3 and the second crankpin P2, respectively. However, the clamping cylinder (not shown) for the second pair of journal clamping plates 39 and 40 remains as it is, whereby the second pair of journal clamping plates 39 and 40 are maintained opened. Closing motions of the clamping cylinders 18 and 22 cause the locating cylinder 55 to operate and then cause the work spindle drive motor to operate, whereby the third journal J3 and the second crankpin P2 of the crankshaft W are given rolling treatments. This rolling step is completed when the work spindle 4 is subsequently stopped at the predetermined angular position. Then, the journal clamping plates 15, 16 and the pin clamping plates 19, 20 are opened, and the positioning plate 25 is lowered to bring the second rocking arm 14*c* into restraint thereby.

The operation of the machine for rolling treatments on the fourth journal J4 and the third crankpin P3 is performed in substantially the same manner as that described earlier for rolling treatments on the third journal J3 and the second crankpin P2. However, it is to be noted that no rotational indexing of the work spindle 4 is performed at the beginning of operation because the third crankpin P3 on the crankshaft W is located at the same angular position as the second crankpin P2. That is, the operation of the machine for rolling treatments on the fourth journal J4 and the third crankpin P3 starts at the indexing of the clamping plates 15, 16, 19 and 20 for respective alignments with the fourth journal J4 and the third crankpin P3, upward movement of the positioning plate 25 and downward movement of the locating cylinder 55 and ends with opening motions of the clamping plates 15, 16, 19 and 20 as well as downward movement of the positioning plate 25. Furthermore, opening motions of the clamping plates 15, 16, 19 and 20 cause the machine to start the operation for rolling treatments on the fifth journal J5 and the fourth crankpin P4 in the same manner as that described earlier for rolling treatments on the third journal J3 and the second crankpin P2.

When the machine operation for rolling treatments on the fifth journal J5 and the fourth crankpin P4 ends with opening motions of the clamping plates 15, 16, 19 and 20 and downward movement of the positioning plate 25, the chuck 5 is caused to unclamp the crankshaft W and the tailstock 6 is retracted to disengage its center 6*a* from the front end of the crankshaft W. The loading/unloading device (not shown) is then reversely operated to unload the processed crankshaft W from the machine, while the head support 9 is moved toward the right as viewed in FIG. 1 to complete the entire machine cycle for the crankshaft W.

Where another crankshaft, which is different from the above-noted crankshaft W in journal-to-journal pitch and journal-to-pin pitch, is to be processed subsequently, the servomotor 35 and 32 are operated in accordance with numerical control data before the head support 9 is indexed from its origin or right stroke end as viewed in FIG. 1 for respective alignments of the first to third rocking arms 14*a*, 14*c* and 14*b* with the second journal J2, the first crankpin P1 and the first journal J1. Accordingly, the space between the first and third rocking arms 14*a* and 14*b* in the axial direction of the work spindle 4 is varied to coincide with a journal-to-journal pitch of the new crankshaft, and the space between the first and second rocking arms 14*a* and 14*c* in the axial direction of the work spindle 4 is varied to coincide with a journal-to-pin pitch of the new crankshaft.

Figure 5:
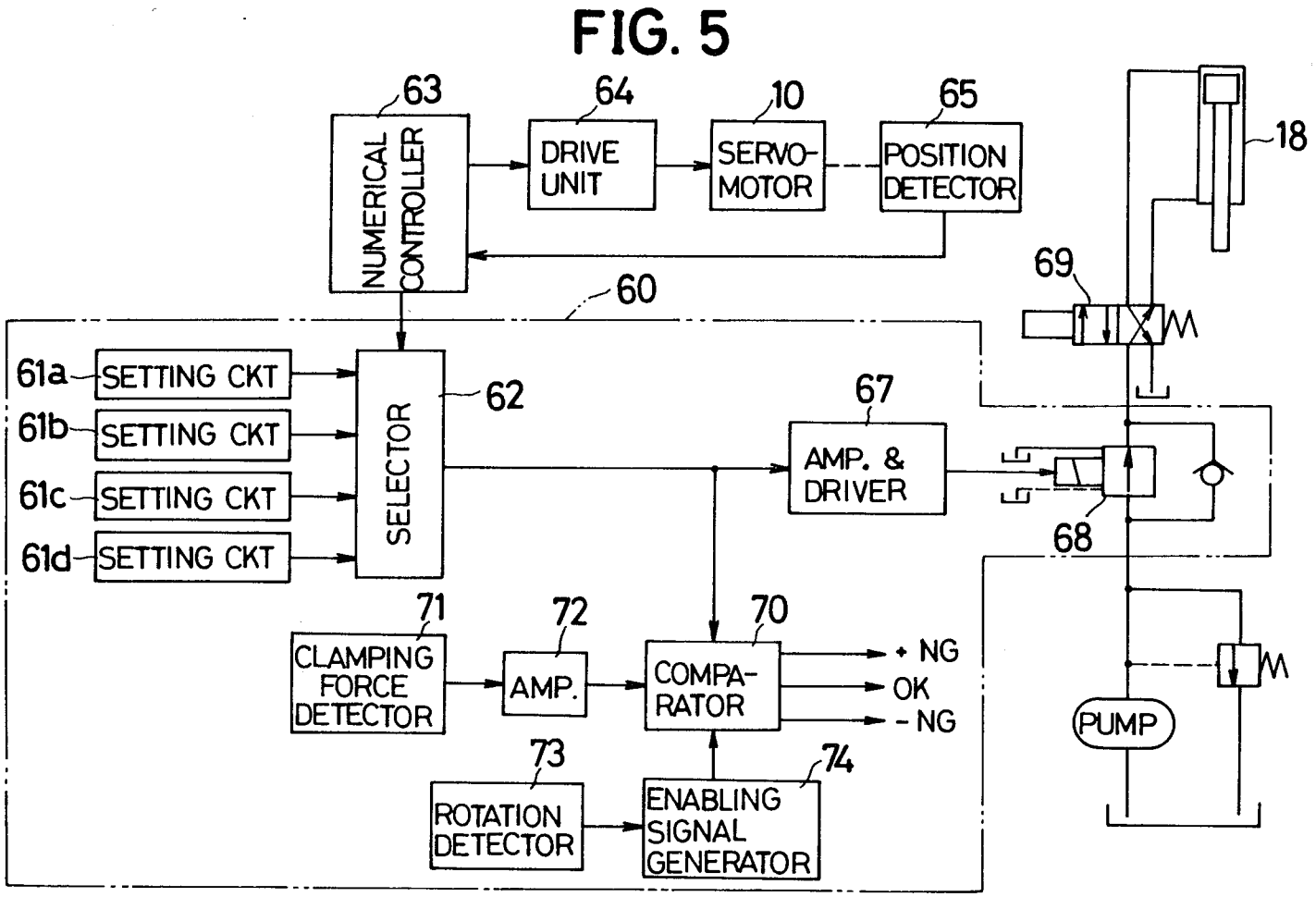
FIG. 5 is a block diagram of a clamping force controller used in the machine.

Referring then to FIG. 5, there is shown a clamping force controller 60 for controlling the clamping force of the first pair of journal clamping plates 15 and 16 depending upon the position of each journal being clamped by the journal clamping plates 15 and 16. The controller 60 comprises first to fourth force setting circuits 61*a*–61*d*, which are respectively assigned to the second to fifth journals J2–J5 of the crankshaft W. A selector 62 is connected to the setting circuits 61*a*–61*d* to receive set force values therefrom and is also connected to a numerical controller 63 to receive selection data therefrom. The numerical controller 63 is capable of controlling rotation of the above-noted servomotor 10 through a drive unit 64. A position detector 65 is operable by the servomotor 10 to detect the slinding position of the head support 9. The detected position of the head support 9 is fed back to the numerical controller 63, which is thus enabled to apply the selection data to the selector 62.

Figure 6:
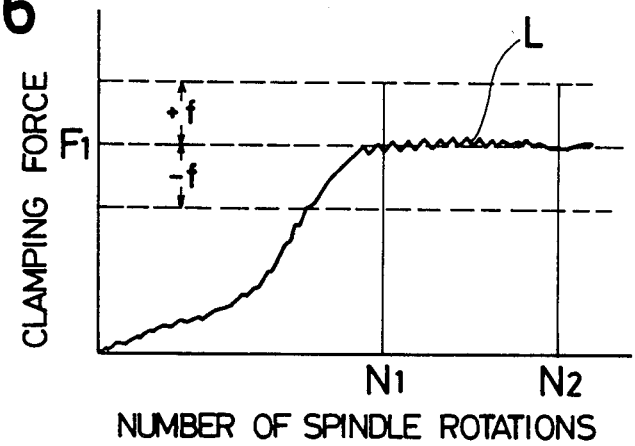
FIG. 6 is a graph showing the relationship between workpiece rotation and clamping force.

Each selected force value is applied to an amplifier and driver 67 which drives a solenoid of a reducing valve 68. The reducing valve 68 reduces the pressure of fluide supplied via a magnetic change-over valve 69 to the clamping cylinder 18 which operates the first set of journal clamping plates 15 and 16. The selected force value is also applied to a comparator 70, which is responsive to an enabling signal to compare the selected force value with data applied thereto from a clamping force detector 71 through an amplifier 72. A rotation detector 73 and an enabling signal generator 74 are provided for generating the enabling signal. The rotation detector 73 is composed of, for example, a proximity switch which is sensitive to a dog plate (not shown) rotatable bodily with the work spindle 4. The enabling signal generator 74 includes a counter (not shown), which counts a pulse signal from the rotation detector 73 and applies the enabling signal to the comparator 70 while the number of work spindle rotations increases from N1 to N2, as shown in FIG. 6.

When the head support 9 is indexed to align the first set of the journal clamping plates 15 and 16 with the second journal J2 of the crankshaft W, the numerical controller 63 responsive to the feedback signal from the position detector 65 outputs selection data which enables the selector 62 to connect the first setting circuit 61*a* to the amplifier and driver 67 as well as the comparator 70. In the same manner, when the third to fifth journals J3–J5 are selectively aligned with the journal clmaping plates 15 and 16, the second to fourth setting circuits 61*b*–61*d* are selectively connected to the amplifier and driver 67 and the comparator 70. Consequently, the solenoid of the reducing valve 68 is controlled so that the clamping force of the journal clamping plates 15 and 16 on each jouranl can be adjusted to a desired value which is determined depending upon the axial position of said each journal on the crankshaft W. Further, the selected value of the selected one of the setting devices 61*a*–61*d* is compared with detected data from the clamping force detector 71 while the number of bodily rotations of the work spindle 4 and the crankshaft W increases from N1 to N2. In this comparison, when the detected data is within a tolerable range which is determined by the selected force value and upper and lower tolerances (+f, −f) shown in FIG. 6, an OK signal is output from the comparator 70. However, when the detected data deviates from the upper or lower tolerance (+f, −f), a +NG signal or a −NG signal is output from the comparator 70, whereby the automatic cycle of the machine is discontinued when the work spindle 4 is thereafter stopped at the predetermined angular position.

Although not shown, another or a second clamping force controller of the same configuation as the aforementioned controller 60 is provided for the pin clamping plates 19 and 20. Accordingly, the clamping force of the pin clamping plates 19 and 20 on each crankpin can be automatically adjusted to a desired value which is determined depending upon the axial position of said each crankpin on the crankshaft W. Where three kinds of crankshafts W are to be successively proccessed by the machine, a third clamping force controller of the same configuration as the first clamping force controller 60 may be further provided for the second pair of the journal clamping plates 39 and 40. In this case, the third clamping force controller may be modified to have three setting circuits which are respectively assigned to first journals of the three kinds of crankshafts W and which are connected to a selector like the setting circuits 61*a*–61*d* shown in FIG. 5. Each of the first and second clamping force controller may also be modified to have, in place of the four setting circuits 61*a*–61*d*, twelve setting circuits which are groupened into three in correspondence to the three kinds of crankshafts W to be processed.

Figure 7:
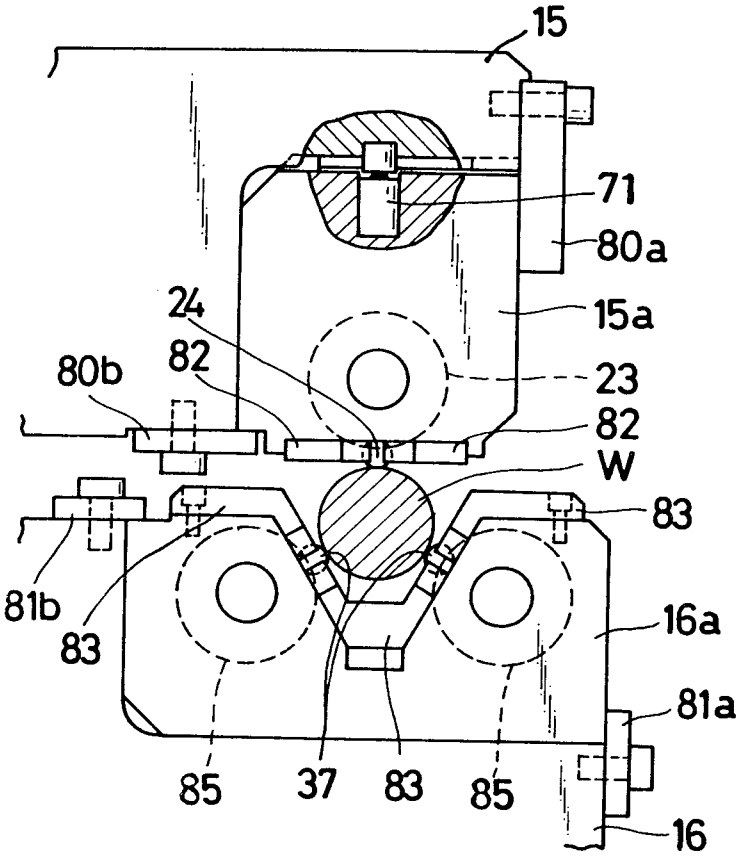
FIG. 7 is an enlarged side view of the front end, partily in section, of a fillet rolling head shown in FIG. 2.

FIG. 7 typically shows the front ends of the first pair of upper and lower journal clamping plates 15 and 16. A pair of mounting pieces 80*a* and 80*b*, secured to the front end of the upper journal clamping plate 15 by means of bolts, detachably mount the upper roller holder 15*a* on the clamping plate 15. Similarly, a pair of mounting pieces 81*a* and 81*b*, secured to the front end of the lower journal clamping plate 16 by means of bolts, detachably mount the lower roller holder 16*a* on the lower clamping plate 16. The upper roller holder 15*a* rotatably carries a back-up roller 23, and a pair of retainers 82 and 82 secured to a lower surface of the upper roller holder 15*a* supports one pair of the fillet rollers 37 rotatable on the back-up roller 23, as shown in FIG. 4. A pair of back-up rollers 85 and 85 are rotatably carried in the lower roller holder 16*a*. Triple retainers 83, 83 and 83, secured to the upper surface of the lower roller holder 16*a*, retain two pairs of fillet rollers 38, each pair being rotatable on one of the back-up rollers 85 and 85, in such a manner that the two pairs of lower fillet rollers 37 cooperate with one pair of the upper filler rollers 37 to clamp and rotatably carry each journal of the crankshaft W at three points, as viewed in FIG. 7. The aforementioned clamping force detector 71 is interposed between the upper surface of the upper roller holder 15*a* and the upper clamping plate 15, and a clearance is defined therebetween, so that upward displacement of the upper roller holder 15*a* enables the clamping force detector 70 to detect an acutual clamping force acting upon each clamped journal during the fillet rolling step.

The front ends of the single pair of pin clamping plates 19 and 20 have the same configuration as those described above with respect to the journal clamping plates 15 and 16. However, the front ends of the second pair of journal clamping plates 39 and 40 are different from those of the first pair of the journal clamping plates 15 and 16 in that the upper roller holder 39*a* supports the single large fillet roller 41 rotatably on the back-up roller (not numbered) and in that the back-up roller 42 carried in the lower roller holder 40*a* is directly engageable with the first or front journal J1 of the crankshaft W.

Obviously, numerous modifications and variations are possible in light of the above teachings. It is therefore to be understood that within the scope of the appended claims, the present invention may be practiced otherwise than as specifically described herein.

What is claimed is:

1. A fillet rolling machine for successively effecting rolling treatments on fillets formed on a crankshaft, comprising in combination:

a frame;

support means mounted on said frame for rotatably carrying a crankshaft to be processed;

drive means connected to said support means for rotating said crankshaft about the axis of the same;

a head support mounted on said frame for movement in a direction parallel to the axis of said crankshaft being rotatably supported by said support means;

rolling head means mounted on said head support for effecting a rolling treatment upon fillets formed on said crankshaft; and indexing feed means connected to said head support and controllable in accordance with numerical control data for moving said head support so as to bring said rolling head means into alignment selectively with said fillets of said crankshaft.

2. A fillet rolling machine as set forth in claim 1, wherein said rolling head means comprises:

a first rolling head for effecting a rolling treatment upon fillets formed on journals of said crankshaft;

a second rolling head for effecting a rolling treatment upon fillets formed on crankpins of said crankshaft; and a rolling head support mechanism for mounting sid first and second rolling heads on said head support with a space in the axial direction of said crankshaft, said space corresponding to a journal-to-pin pitch of said crankshaft.

3. A fillet rolling machine as set forth in claim 2, wherein said rolling head support mechanism includes:

a first support shaft extending in parallel relation with the axis of said crankshaft and carrying said first rolling head;

an axially movable second support shaft extending in parallel relation with said first support shaft and carrying said second rolling head; and space adjusting means connected to said second support shaft and having a servomotor controllable in accordance with said numerical control data for axially moving said second support shaft so as to adjust the space between said first and second rolling heads to said journal-to-pin pitch.

4. A fillet rolling machine as set forth in claim 3, wherein each of said first and second rolling heads comprises:

a rocking arm carried by an associated one of said first and second support shafts for rocking motion within a plane perpendicular to the axis of said crankshaft;

a pair of clamping plates carried by said rocking arm for pivotal movement relative to said rocking arm within said plane and capable of opening and closing their front ends;

a plurality of fillet rollers rotatably carried at the front ends of said pair of said clamping plates; and actuation means connected to said pair of said clamping plates for causing the same to selectively open and close the front ends thereof, each of said fillet rollers being engageable with a fillet formed on one of said journal and crankpin aligned therewith, of said crankshaft when the front ends of said clamping plates are closed.

5. A fillet rolling machine as set forth in claim 4, further comprising:

position data generating means for generating position data indicating the position of said support head in the axial direction of said crankshaft;

a clamping force controller connected to said actuation means of said first rolling head and responsive to said position data for controlling the operation of said actuation means so as to adjust the clamping power generated by said actuation means in dependence upon the moving position of said head support, whereby the clamping force upon each of said journals is changed from the clamping force upon another of said journals.

6. A fillet rolling machine as set forth in claim 5, wherein said actuation means is composed of a hydraulic cylinder and wherein said clamping force controller comprises:

a magnetic reducing valve connected to said hydraulic cylinder for reducing the pressure of fluid supplied to said hydraulic cylinder;

a plurality of setting circuits respectively assigned to said journals of said crankshaft for setting clamping forces which are to act respectively on said journals;

a selector connected to said plurality of said setting circuits and responsive to said position data from said position data generating means for selectively outputting said clamping forces; and a drive circuit connected to said selector and said magnetic reducing valve for driving said magnetic reducing valve so as to enable said hydraulic cylinder to generate one of said clamping forces designated by said selector.

7. A fillet rolling machine as set forth in claim 6, wherein said clamping force controller further comprises:

enabling signal generating means for generating an enabling signal while the number of rotations of said crnakshaft is increased from a first predetermined number to a second predetermined number;

a clamping force detector incorporated in the front end of one of said clamping plates constituting said first rolling head for detecting an actual clamping force acting upon a fillet formed on one of said journals being clamped by said clamping plates; and a comparator connected to said selector and said clamping force detector and responsive to said enabling signal for comparing one of said clamping forces selected by said selector with said actual clamping force so as to issue an abnoral signal when said actual clamping force deviates from said selected clamping force more than a predetermined value.

8. A fillet rolling machine as set forth in claim 7, wherein said rolling head means further includes:

a third rolling head for effecting a rolling treatment on a fillet formed at a front journal of said crankshaft;

said rolling head support mechanism also mounting on said head support said third rolling head being spaced from said first rolling head in the axial direction of said crankshaft by a distance corresponding to a pitch between said front journal and another journal next thereto of said crankshaft.

9. A fillet rolling machine as set forth in claim 8, wherein said rolling head support mechanism further comprises:

an axially movable third support shaft extending in co-axial alignment with said first support shaft and pivotably carrying said third rolling head; and another space adjusting means connected to said third support shaft and having a servomotor controllable in accordance with said numerical control data for moving said third support shaft so as to automatically adjust the space between said first and third rolling heads in correspondence to the pitch between said front journal and said another journal next thereto of said crankshaft.

10. A fillet rolling machine as set forth in claim 9, wherein:

said third rolling head rotatably carries a single fillet roller engageable with said fillet formed at said front journal of said crankshaft.

* * * * *